United States Patent [19]

Macario

[11] Patent Number: 4,993,584

[45] Date of Patent: Feb. 19, 1991

[54] FOOD CONTAINER

[75] Inventor: Giuseppe Macario, Grugliasco, Italy

[73] Assignee: GI & GI. S.r.l., Turin, Italy

[21] Appl. No.: 349,426

[22] Filed: May 9, 1989

[30] Foreign Application Priority Data

May 10, 1988 [IT] Italy ..... 5313088[U]

[51] Int. Cl.[5] ..... A47G 19/12

[52] U.S. Cl. ..... 220/523; 220/524; 222/142.1; 222/142.4; 222/142.8; 222/480

[58] Field of Search ..... 220/22, 23, 83, 507, 220/524, 523; 222/132, 142.1, 142.4, 142.5, 142.8, 480, 481, 482, 559; 221/92, 96, 123, 124, 132

[56] References Cited

U.S. PATENT DOCUMENTS

| | | | |
|---|---|---|---|
| 519,601 | 5/1894 | Dryfoos | 222/142.1 |
| 734,165 | 7/1903 | Drewery | 222/132 |
| 1,086,943 | 2/1914 | Schorn | 222/142.1 |
| 2,047,081 | 7/1936 | Roch et al. | 222/142.8 |
| 2,048,381 | 7/1936 | Hodek | 222/142.8 |
| 2,469,034 | 5/1949 | Garris | 222/132 |
| 2,514,416 | 7/1950 | Plunkett | 222/480 |
| 2,558,251 | 6/1951 | Holsted | 222/482 |
| 2,772,023 | 11/1956 | Smith | 222/142.4 |
| 2,934,242 | 4/1960 | Lykes | 222/142.4 |
| 3,052,368 | 9/1962 | Atkins et al. | 220/22 |
| 3,096,910 | 7/1963 | Pehr | 222/142.5 |
| 3,258,369 | 7/1966 | Blaich | 220/22 |
| 3,323,683 | 6/1967 | Cianciolo | 222/480 |
| 3,332,586 | 7/1967 | Amburgey | 222/480 |
| 4,277,000 | 7/1981 | Jaarsma | 222/142.4 |

FOREIGN PATENT DOCUMENTS

| | | | |
|---|---|---|---|
| 1198024 | 8/1965 | Fed. Rep. of Germany | 222/142.1 |
| 2000004 | 1/1979 | United Kingdom | 222/480 |

*Primary Examiner*—David T. Fidei

*Attorney, Agent, or Firm*—Kane, Dalsimer, Sullivan, Kurucz, Levy, Eisele and Richard

[57] ABSTRACT

A food container is described which has a body in which are formed at least one liquid food compartment having an outlet formed in the top of the body, and at least one granulated food compartment having an outlet formed in the bottom of the body.

20 Claims, 2 Drawing Sheets

FOOD CONTAINER

BACKGROUND OF THE INVENTION

The present invention relates to a food container.

Currently marketed containers are designed for a wide variety of foodstuffs, in both liquid and granulated form, e.g. salt and pepper. Most of these, however, are designed for one type of foodstuff, i.e. liquid or granulated, or are divided into two compartments, both containing liquid foodstuffs.

SUMMARY OF THE INVENTION

The aim of the present invention is to provide a food container featuring a number of compartments, some for liquid and others for granulated foodstuffs.

With this aim in view, according to the present invention, there is provided a food container, characterised by the fact that it comprises a body having a bottom wall and inside which are formed at least a first liquid food compartment having an outlet formed in the top of said body, and at least a second substantially granulated food compartment having an outlet formed in the bottom of said body.

BRIEF DESCRIPTION OF THE DRAWINGS

A preferred embodiment of the present invention will be described by way of a non-limiting example with reference to the accompanying drawings, in which.

DETAILED DESCRIPTION OF THE INVENTION

Figure 1:
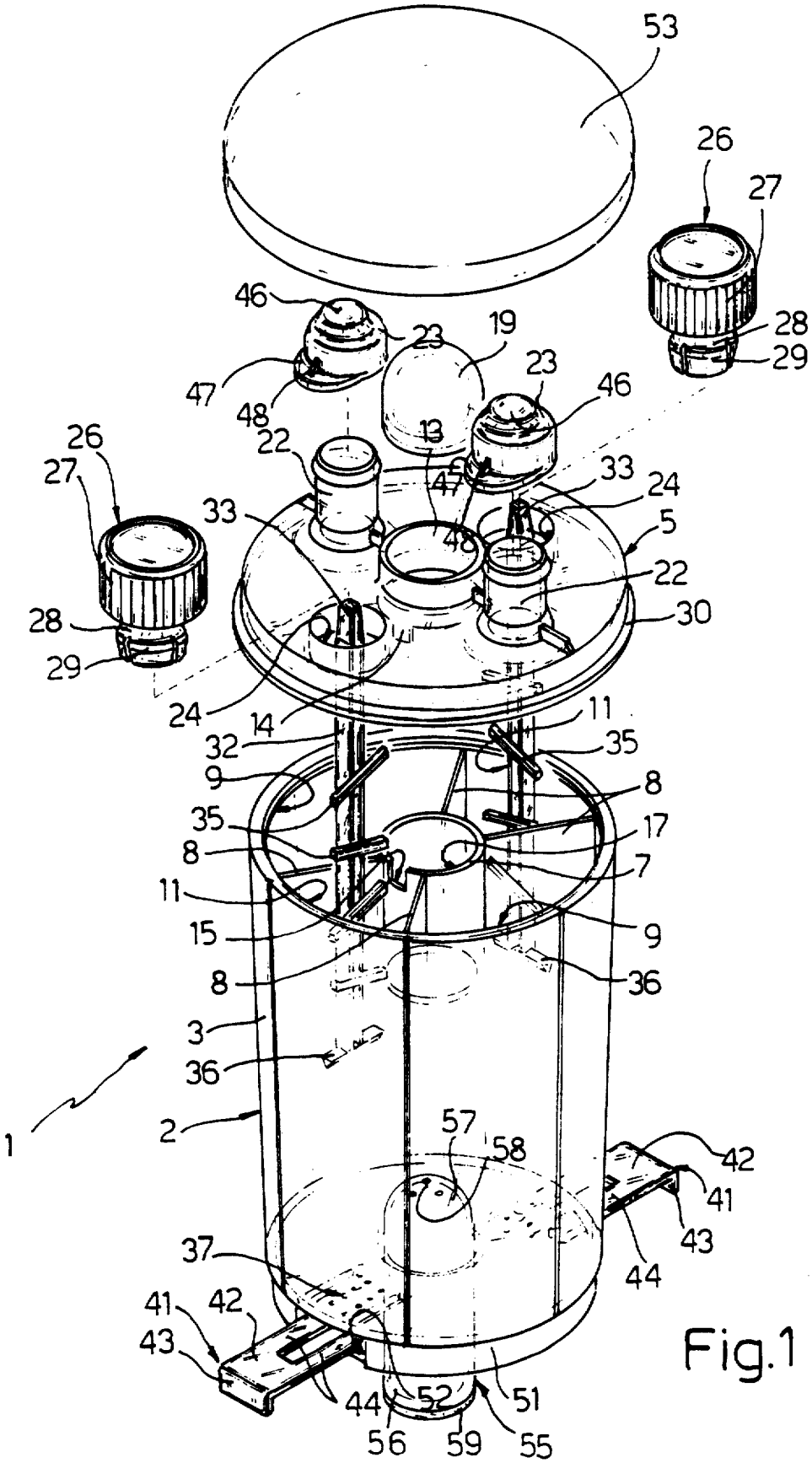
FIG. 1 shows an exploded view in perspective of a container in accordance with the teachings of the present invention.
Figure 2:
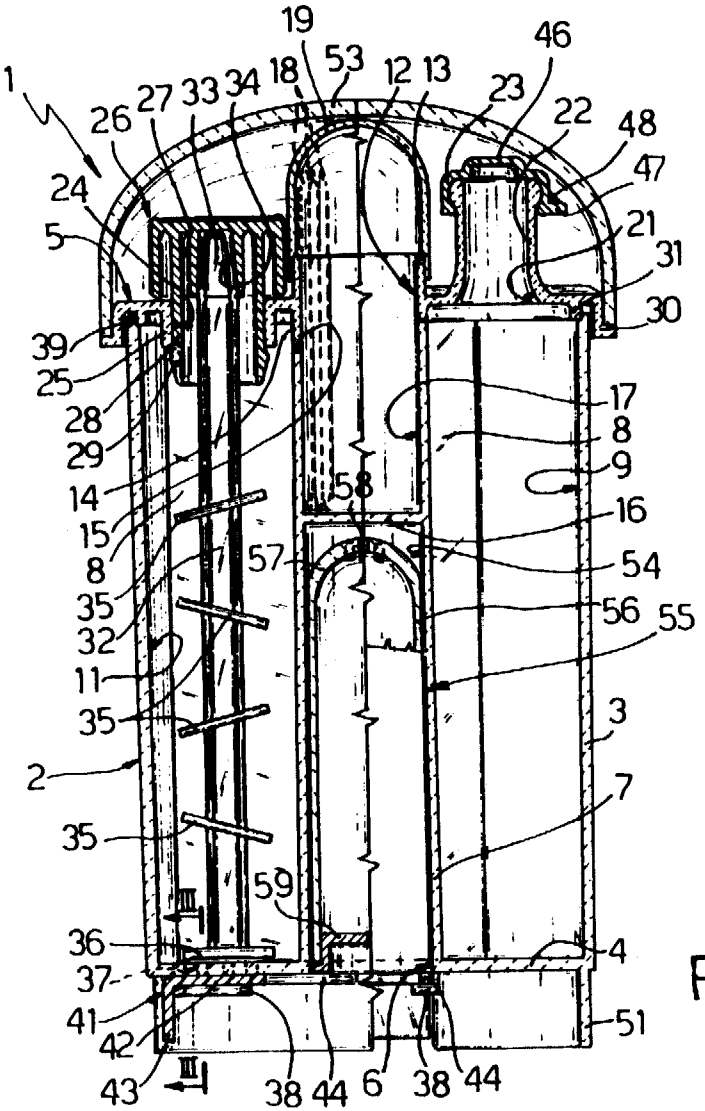
FIG. 2 shows a cross section of the FIG. 1 container.

Number 1 in FIGS. 1 and 2 indicates a food container having a cylindrical center body 2 inside which are defined a number of compartments, some for liquid foodstuffs, such as vinegar or oil, and others for granulated foodstuffs, such as salt or sugar.

Said body 2 is preferably formed in one piece from transparent plastic material, and comprises a cylindrical lateral wall 3, a bottom wall 4 integral with the bottom edge of lateral wall 3, and a lid 5 fitted on to and sealing the top edge of lateral wall 3. Bottom wall 4 presents a central through hole 6 from the edge of which a hollow cylinder 7 extends upwards, coaxial with lateral wall 3, and having its top edge flush with the top edge of the same. Between the outer surface of cylinder 7 and the inner surface of lateral wall 3, there are formed four dividing walls 8 lying in radial planes in relation to the longitudinal axis of cylinder 7. Said walls 8 extend from bottom wall 4, with the top edges flush with the top edge of cylinder 7, so as to define four compartments, two numbered 9 for liquid foodstuffs, and two numbered 11 for granulated foodstuffs. As described in detail later on, lid 5 is specially designed to ensure compartments 9 and 11 are sealed off from one another. Compartments 9 are of equal volume, but greater than that of compartments 11, and are arranged diametrically opposite in relation to cylinder 7 (and hence also compartments 11) by virtue of each pair of dividing walls 8 lying in the same plane.

As shown in FIGS. 1 and 2, lid 5 is formed in one piece from transparent plastic material, and presents a flat wall with a central through hole 12 through which is fitted a cylindrical sleeve 13 coaxial with and of the same diameter as cylinder 7. Sleeve 13 presents a downward-extending portion having its bottom edge resting on the top edge of cylinder 7. The bottom edge of sleeve 13 presents a downward-extending tab 14 designed, when lid 5 is closed, to engage a slot 15 formed on the top edge of cylinder 7. Engagement of tab 14 inside slot 15 indicates correct fitment of lid 5 in relation to compartments 9 and 11. Inside a top portion of cylinder 7, there is formed a dividing wall 16 defining a central compartment 17 for toothpicks 18, as shown in FIG. 2. Wall 16 is so located that toothpicks 18 project beyond the top edge of sleeve 13 for easy removal. A lid 19 is fitted on to the edge of sleeve 13 to prevent toothpicks 18 from falling out of compartment 17.

In lid 5, over each compartment 9, there is formed a through hole 21, from the edge of which a substantially cylindrical sleeve 22 extends upwards, with an enlarged top edge engaged by an airtight cap 23. Each cap 23 presents an annular element engaged internally by the enlarged edge of sleeve 22, and presenting, on top, a further cap 46 for fitting a drip collecting fixture inside sleeve 22. From the bottom edge of said annular element, there extends a tab 47 by which cap 23 is released by the user. Between said annular element and tab 47, provision is also made for a strengthening rib 48. Each sleeve 22 thus forms an outlet for the liquid foodstuff inside each compartment 9. In lid 5, over each compartment 11, there is formed a through hole 24, from the edge of which an annular appendix 25 extends downwards. Hole 24 is sealed by a cap 26 having a wide head 27, which remains over lid 5, and a hollow cylindrical shank 28 engaging annular appendix 25 and locked to the same via annular tooth 29 formed on the bottom end of shank 28. Lid 5 presents a turned-out L-section edge 30 near which, on the underside of lid 5, there is formed a small annular appendix 31 defining, together with edge 30, an annular seat 39 engaged by the top edge of lateral wall 3 of body 2.

Each compartment 11 houses a rod 32, which is secured vertically and centrally inside compartment 11 by a tapered top end 33 fitted inside a seat 34 formed in the center of head 27 of cap 26. Rod 32 is fitted with a number of small rectangular-section strips 35, each set obliquely in relation to the longitudinal axis of rod 32. In particular, rod 32 is fitted with four equally-spaced strips 35 sloping alternately in the same direction but differently from that of the adjacent strip. Rod 32 is turned about its longitudinal axis by twisting head 27 of cap 26, which, via strips 35, provides for loosening any compacted foodstuff inside compartment 11. The bottom end of rod 32 is fitted with a triangular-section strip 36 having its longitudinal axis perpendicular to that of rod 32, and one apex close to bottom wall 4. When rod 32 is turned, strip 36 provides for scraping off any foodstuff adhering to bottom wall 4.

Figure 3:
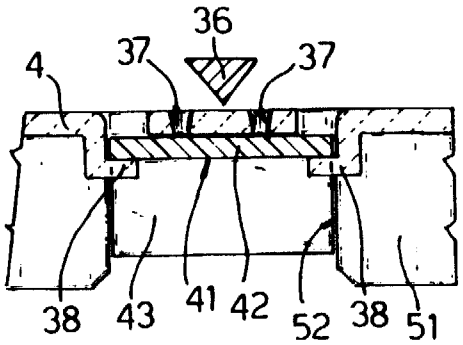
FIG. 3 shows a larger-scale section along line III—III in FIG. 2.
Figure 5:
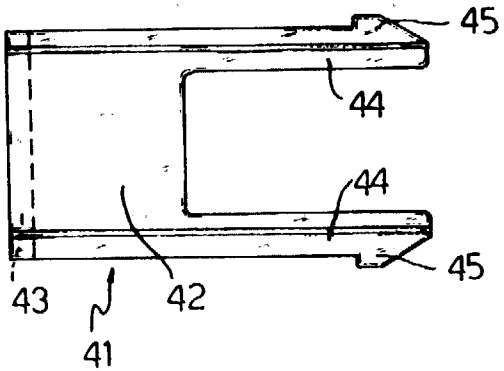
FIG. 5 shows a larger-scale plan view of a detail on the FIG. 1 container.
Figure 4:
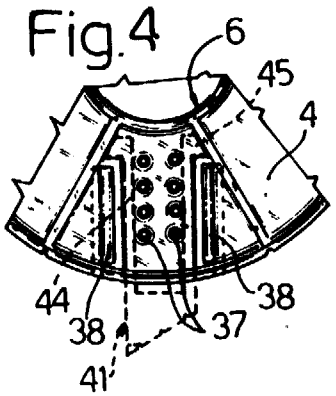
FIG. 4 shows a partial underside view of the bottom wall on the FIG. 1 container.

With reference to FIGS. 1, 3 and 4, bottom wall 4 of compartments 11 presents a number of small through holes 37 arranged in two parallel rows, substantially radially in relation to the center portion of bottom wall 4, and which form an outlet for the granulated foodstuff inside compartments 11. On the underside of bottom wall 4, on either side of said two rows of holes 37, there are formed two rails 38 along which slides a panel 41 (FIG. 5). Panel 41 comprises a solid portion 42, from a first edge of which a grip tab 43 extends downwards, and from the ends of the opposite edge of which extend two parallel appendixes 44. Each appendix 44 presents an outward-facing end tooth 45, which acts as a stop for preventing total removal of panel 41 off rails 38. Panel 41 is designed to assume a first position, wherein said solid portion 42 is located underneath holes 37, thus closing off the same; and a second position, wherein said solid portion 42 is slid out along rails 38, thus positioning the space defined between appendixes 44 beneath holes 37, and so enabling withdrawal through holes 37 of the granulated foodstuff inside compartment 11. It should be pointed out that the thickness of solid portion 42 and the clearance between rails 38 and the underside of bottom wall 4 are such that solid portion 42 contacts the underside of bottom wall 4, and a certain amount of pull is required for extracting panel 41, thus preventing accidental withdrawal of the same in the event of container 1 being dropped or laid horizontally. Moreover, said holes 37 are tapered, and teeth 45, in said second position of panel 41, contact the inner end of rails 38.

With reference to FIG. 2, from the outer edge of bottom wall 4 and substantially in line with lateral wall 3, an annular appendix 51 extends downwards beyond tab 43 of panel 41. Said appendix 51 acts as a support for body 2, and defines an inner space housing panels 41, which extend radially outwards of said space through respective slots 52 formed in appendix 51 (FIG. 3). Container 1 also presents a bowl-shaped hood 53 preferably formed from transparent plastic material and the bottom edge of which mates with edge 30 of lid 5. The bottom portion of cylinder 7 defines a compartment 54 housing a container 55, e.g. for pepper. Container 55 presents a cylindrical element 56, the top end of which presents a bowl 57 with small holes 58, and the bottom end of which is fitted with an airtight cap 59. In actual use, container 55 rests on the portion of appendixes 44 of panels 41 corresponding with hole 6, when panels 41 are located in said first position. The advantages of the present invention will be clear from the foregoing description. In particular, it provides for a single container with compartments for both liquid and granulated foodstuffs, and having outlets on the lid and bottom wall of the container respectively. Moreover, means are provided for loosening compacted granulated foodstuff, as well as means for scraping the bottom wall of the granulated food compartments. Said first means may also be employed for blending different substances inside compartment 11, such as salt, pepper and herbs for seasoning food.

To those skilled in the art it will be clear that changes may be made to container 1 as described and illustrated herein without, however, departing from the scope of the present invention. For example, the number of compartments 9 and 11 may differ from that illustrated herein. Also, the outlets of compartments 9 may be in the form of spouts formed close to the top edge of lateral wall 3. The same also applies for holes 37, which may be formed close to the bottom edge of wall 3.

I claim:

1. A food container comprising:

a body (2), a top and a bottom wall (4);

said body being formed with a plurality of compartments, including a first liquid food compartment (9) having a liquid dispensing outlet (22) formed in said top, and a second substantially solid granulated food compartment (11) for holding solid granulated foodstuff, with a solid dispensing outlet (37) formed in said bottom wall;

wherein said solid dispensing outlet (37) is formed in said bottom wall (4);

wherein said solid dispensing outlet comprises number of first through holes formed in said bottom wall (4); wherein said container includes rails (38) and a panel (41) designed to slide in contact with said bottom wall (4) and along said rails (38), and said panel having a first position, in which the panel closes off said first through holes (37) and a second position, in which the panel permits downward withdrawal of said granulated foodstuff through said first through holes (37).

2. A container as claimed in claim 1, characterised by the fact that said rails (38) are formed on the outer face of said bottom wall (4) of said body (2).

3. A container as claimed in claim 1, characterised by the fact that said first holes (37) are arranged in a number of parallel rows.

4. A container as claimed in claim 1, characterised by the fact that said panel (41) comprises a solid portion (42) designed, in said first position, to close off said first holes (37); two appendixes (44) between which is defined a space which, in said second position, is located beneath said first holes (37); and a grip tab (43).

5. A container as claimed in claim 4 wherein said bottom wall has an edge, and said container further comprises an appendix (51) extending downwardly from said edge, said appendix acting as a support for said body and defining an inner space for housing said panel (41), said appendix including a slot (52), said panel (41) being arranged to slide through said slot when moved between said first and said second positions.

6. A container as claimed in claim 5 further including a top lid (5) formed with said first liquid dispensing outlet (22).

7. A container as claimed in claim 6, characterised by the fact that said lid (5) presents means (39) for securing it to the top edge of said body (2).

8. A container as claimed in claim 6, wherein said lid includes a second through hole (21) and wherein said liquid dispensing outlet comprises a sleeve (22) having a first airtight cap (23) and extending upwards from said second through hole (21) over said first compartment.

9. A container as claimed in claim 6, fact that it comprises predetermined positioning means (14 and 15) for positioning said lid (5) on the top edge of said body (2).

10. A container as claimed in claim 6, further comprising a central element (7) formed inside and coaxially with said body (2); and dividing walls (8) formed between said central element (7) and the lateral wall (3) of said body (2), and defining said compartments (9 and 11).

11. A container as claimed in claim 10, wherein said central element has a top portion and wherein a third compartment (17) is formed in said top portion open at the top and accessible via a third through hole (12) formed in said lid (5).

12. A container as claimed in claim 11, said central element has a bottom portion and wherein a fourth compartment in said bottom portion housing an element (55) filled with a granulated foodstuff, such as pepper or similar material, said element (55) having small holes (58) at the top, an airtight cap (59) at the bottom, and being designed to rest on portions of said panels (41).

13. A container as claimed in claim 6, wherein said second compartment (11) houses a rod (32) which may be turned manually about its longitudinal axis; said rod (32) being fitted with a number of strips (35) which, when said rod (32) is turned, provide for loosening any compacted foodstuff inside said second compartment (11).

14. A container as claimed in claim 13, wherein said rod has a bottom end fitted with a perpendicular strip (36) having a sharp edge located close to said bottom wall (4) for scraping off any foodstuff adhering to said bottom wall (4) when said rod (32) is rotated.

15. A container as claimed in claim 13, wherein said lid (5) has a fourth through hole (24) through which the top end of said rod (32) extends upwards to engage a seat (34) formed in a second cap (26) providing for airtight sealing of said fourth hole (24).

16. A container as claimed in claim 15, further comprising a bowlshaped hood (53) having a bottom edge designed to mate with the edge of said lid (5).

17. A container as claimed in claim 1, wherein said body (2) is substantially cylindrical.

18. A container as claimed in claim 17, wherein said body (2) has two said first compartments (9) arranged diametrically opposite in relation to a longitudinal axis of said body (2).

19. A container as claimed in claim 18, wherein said body (2) has two said second compartments (11) arranged diametrically opposite in relation to a longitudinal axis of said body (2).

20. A container as claimed in claim 1, wherein said body is formed in one piece from a preferably transparent plastic material.

* * * * *